US007575811B2

(12) United States Patent
Uchida et al.

(10) Patent No.: US 7,575,811 B2
(45) Date of Patent: Aug. 18, 2009

(54) ALUMINUM ALLOY SHEET FOR SUPERPLASTIC FORMING

(75) Inventors: Hidetoshi Uchida, Tokyo (JP); Yasunori Nagai, Tokyo (JP); Takamichi Watanabe, Tokyo (JP); Hitoshi Kazama, Wako (JP); Osamu Yokoyama, Haga-machi (JP); Kazuya Saito, Haga-machi (JP)

(73) Assignees: Sumitomo Light Metal Industries, Ltd., Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/511,894

(22) Filed: Aug. 29, 2006

(65) Prior Publication Data

US 2007/0048539 A1 Mar. 1, 2007

(30) Foreign Application Priority Data

Aug. 30, 2005 (JP) ..... 2005-249662

(51) Int. Cl.
*B32B 9/00* (2006.01)

(52) U.S. Cl. ..... 428/469; 428/472; 428/701; 428/702

(58) Field of Classification Search ..... 428/650, 428/654, 632, 633, 215, 336; 72/41, 42, 72/43

See application file for complete search history.

(56) References Cited

U.S. PATENT DOCUMENTS

| | | | | | |
|---|---|---|---|---|---|
| 3,210,184 | A | * | 10/1965 | Uhlig | 430/65 |
| 4,250,727 | A | * | 2/1981 | Baril et al. | 72/46 |
| 5,059,258 | A | * | 10/1991 | Wefers et al. | 148/272 |
| 5,819,572 | A | * | 10/1998 | Krajewski | 72/42 |

FOREIGN PATENT DOCUMENTS

| | | | |
|---|---|---|---|
| JP | 05-271954 | * | 10/1993 |
| JP | 08-187818 | | 7/1996 |
| JP | 2000-054156 | * | 2/2000 |

* cited by examiner

*Primary Examiner*—Timothy M Speer
(74) *Attorney, Agent, or Firm*—Flynn, Thiel, Boutell & Tanis, P.C.

(57) ABSTRACT

A hydrous oxide film is formed on the surface of a superplastic forming aluminum alloy sheet. The superplastic forming aluminum alloy sheet can be formed without applying a lubricant to a die, exhibits excellent releasability, and prevents scratches due to sliding between the die and the sheet.

3 Claims, No Drawings

ALUMINUM ALLOY SHEET FOR SUPERPLASTIC FORMING

BACKGROUND OF THE INVENTION

1. Field of the Invention

The present invention relates to an aluminum alloy sheet for superplastic forming. In particular, the present invention relates to an aluminum alloy sheet for superplastic forming of which the surface quality does not deteriorate during forming to provide a formed product with an improved quality and which exhibits improved scratch resistance when sliding occurs between a die and a material during forming.

2. Description of Related Art

In superplastic forming of an aluminum alloy sheet, an aluminum alloy sheet is generally formed at a high temperature by causing the aluminum alloy sheet to undergo a large amount of plastic deformation utilizing gas pressure. The superplastic forming method is suitable for small-quantity production of various products, since the aluminum alloy sheet can be formed into a complicated shape by processing the sheet once, and the die and the manufacturing equipment are inexpensive in comparison with those used for cold press forming.

In recent years, the cycle time of superplastic forming has been reduced through optimization of the forming conditions and equipment. Therefore, superplastic forming has also been applied to form mass-produced automotive outer panels. Since superplastic forming is a high-temperature treatment, a lubricant such as boron nitride (BN) or graphite is generally applied to the forming target aluminum alloy sheet to prevent the aluminum alloy sheet from adhering to the die or bead portion.

On the other hand, when forming mass-produced parts or formed products for which a high surface quality is required, scratches inevitably occur due to sliding between the die and the sheet, even if the lubricant is applied. The surface quality deteriorates due to deposition of the lubricant on the die. Moreover, it is difficult to automatize application of the lubricant. As a result, a decrease in efficiency and an increase in cost cannot be avoided.

In order to improve cold press formability, a method has been proposed in which an anodic oxide film is formed on the surface of the aluminum material and an organic resin film such as a polyurethane resin film in which a lubricant such as polyolefin wax fine powder particles are dispersed is formed on the anodic oxide film (see JP-A-8-187818). On the other hand, when applying this method to superplastic forming of an aluminum alloy sheet, a sufficient effect cannot be necessarily obtained.

SUMMARY OF THE INVENTION

The present invention was achieved as a result of experiments and investigations conducted on the relationship among surface treatment, releasability, occurrence of scratches due to sliding between a die and a sheet, and the like in order to solve the above-described related-art problems relating to an aluminum alloy sheet which occur when superplastic forming mass-produced products or formed products for which a high surface quality is required. An object of the present invention is to provide a superplastic forming aluminum alloy sheet which can be formed without applying a lubricant to a die, exhibits excellent releasability, prevents scratches due to sliding between the die and the sheet, and of which the surface quality does not deteriorate due to deposition of the lubricant on the die to improve the quality of the formed product and working efficiency and reduce the manufacturing cost.

In order to achieve the above object, a first aspect of the present invention provides a superplastic forming aluminum alloy sheet comprising a hydrous oxide film formed on a surface.

A second aspect of the present invention provides a superplastic forming aluminum alloy sheet comprising a two-layer film including an aluminum hydroxide film and a hydrous oxide film formed on a surface.

In the above superplastic forming aluminum alloy sheet, the film formed on one surface may have a thickness of 10 μm or less.

In the above superplastic forming aluminum alloy sheet, the aluminum alloy sheet may be a 5000 series aluminum alloy sheet or a 6000 series aluminum alloy sheet.

According to the present invention, a superplastic forming aluminum alloy sheet is provided which can be formed without applying a lubricant to a die, exhibits excellent releasability, prevents scratches due to sliding between the die and the sheet, and of which the surface quality does not deteriorate due to deposition of the lubricant on the die to improve the quality of the formed product and working efficiency and reduce the manufacturing cost.

DETAILED DESCRIPTION OF THE INVENTION AND PREFERRED EMBODIMENT

The present invention may be applied to aluminum alloys which can be subjected to superplastic forming. In particular, the present invention is effective when applied to a 5000 series aluminum alloy or a 6000 series aluminum alloy.

A non-heat-treatable 5000 series aluminum alloy exhibits the highest strength in a softened state, and has been widely used as a superplastic forming material. Among the 5000 series aluminum alloys, a 5083 alloy, 5182 alloy, 5052 alloy, and the like may be suitably used which allow the present invention to exhibit its effects.

A 6000 series aluminum alloy has a bake hardenability and may be reduced in thickness in comparison with the 5000 series aluminum alloy. Therefore, the 6000 series aluminum alloy has been widely used as an automotive outer panel material, and superplastic forming the 6000 series aluminum alloy has been put to practical use.

In the present invention, a hydrous oxide film is formed on the surface of the superplastic forming aluminum alloy sheet. The hydrous oxide film is a boehmite film or a bayerite film. The formation method for the hydrous oxide film is not limited. For example, the hydrous oxide film may be formed by immersing the aluminum alloy sheet in a neutral liquid (e.g. tap water or pure water) at about 50° C. or more or in a weak alkaline solution containing ammonia or the like, or exposing the aluminum alloy sheet to saturated steam.

When an aluminum hydroxide film is formed on the surface of the aluminum alloy sheet and the above hydrous oxide film is then formed on the aluminum hydroxide film, more stable effects can be obtained by the two-layer film. The aluminum hydroxide film may be formed by alkali-etching the surface of the aluminum alloy using a known alkaline solution, for example. The term "surface of the aluminum alloy" refers to at least the surface which comes into contact with the die during superplastic forming. Note that the film may also be formed on the other surface.

The film is preferably formed to a thickness of 10 μm or less on one surface. If the thickness of the film formed on one surface exceeds 10 μm, cracks occur to a large extent in the film during superplastic forming, whereby the film is easily separated. As a result, the film cannot exert its effects. The thickness of the film formed on one surface is still more preferably 0.1 to 3 μm.

The hydrous oxide film or the two-layer film including the hydrous oxide film and the aluminum hydroxide film prevents adhesion of the aluminum alloy to the die after forming. Therefore, application of a lubricant such as BN or graphite to the surface of the aluminum alloy sheet which has been employed to prevent adhesion of the aluminum alloy to the die or the bead portion can be omitted, whereby deterioration of the surface quality due to deposition of the lubricant can be prevented. Moreover, scratches due to sliding between the die and the sheet can be prevented by forming the above film.

EXAMPLES

The present invention is described below by way of examples and comparative examples. Note that the following examples illustrate only one embodiment of the present invention. The present invention is not limited to the following examples.

A hydrous oxide film or a two-layer film of a hydrous oxide film and an aluminum hydroxide film was formed on the surface of an aluminum alloy sheet (temper: O, thickness: 1.5 mm) shown in Table 1. The hydrous oxide film was formed by immersing the aluminum alloy sheet in tap water at 95° C., and the aluminum hydroxide film was formed by etching the aluminum alloy sheet using an alkaline washing agent. The thickness of the film was adjusted by adjusting the film formation treatment time.

The aluminum alloy sheet on which the above film was formed was washed to prepare ten test specimens for each test specimen number. Each test specimen was placed in a superplastic forming machine and subjected to superplastic forming at a temperature of 500° C. for six minutes at a pressure of 9 atm using nitrogen gas to obtain a prism-shaped panel with a length of 250 mm, a width of 250 mm, and a height (depth) of 80 mm.

Releasability from the die and the presence or absence of scratches on the surface of the formed panel were investigated according to the following methods. Table 1 shows the film formed on each test specimen and the thickness of the film formed on one surface, and Table 2 shows the presence or absence of scratches on the surface and releasability results.

Releasability:

A case where the formed product was easily removed from the die using metal chopsticks without adhering to the die was indicated as "Excellent", a case where the formed product was not deformed was indicated as "Good", and a case where the formed product was deformed due to adhesion to the die was indicated as "Bad".

Surface Scratches:

A case where scratches due to sliding between the die and the material were not observed by visual observation or a case where the scratches had a depth of 1 μm or less was indicated as "Excellent", a case where the scratches had a depth of less than 3 μm was indicated as "Good", and a case where the scratches had a depth of 3 μm or more was indicated as "Bad".

TABLE 1

| No. | Alloy | Film | Film thickness (μm) | Remarks |
|---|---|---|---|---|
| 1 | 5083 | Hydrous oxide | 0.02 | Invention |
| 2 | 5083 | Hydrous oxide | 0.7 | Invention |
| 3 | 5083 | Hydrous oxide | 1.8 | Invention |
| 4 | 5083 | Hydrous oxide | 15 | Comparison |
| 5 | 5182 | Hydrous oxide | 2 | Invention |
| 6 | 5052 | Hydrous oxide | 1.5 | Invention |
| 7 | 6061 | Hydrous oxide | 3 | Invention |
| 8 | 5083 | Aluminum hydroxide + hydrous oxide | 0.9 | Invention |
| 9 | 5083 | Aluminum hydroxide + hydrous oxide | 2.4 | Invention |
| 10 | 5083 | Film was not formed | | Comparison |
| 11 | 5083 | Film was not formed and BN was applied | | Comparison |

TABLE 2

| No. | Surface scratches | Releasability |
|---|---|---|
| 1 | Good | Good |
| 2 | Excellent | Excellent |
| 3 | Excellent | Excellent |
| 4 | Excellent | Excellent |
| 5 | Excellent | Excellent |
| 6 | Excellent | Excellent |
| 7 | Excellent | Excellent |
| 8 | Excellent | Excellent |
| 9 | Excellent | Excellent |
| 10 | Bad | Bad |
| 11 | Bad | Good |

Note:
Cracks occurred in the test specimen No. 4 after forming.

As shown in Table 2, the test specimens 1 to 3 and 5 to 9 according to the present invention exhibited excellent releasability. In the test specimens 1 to 3 and 5 to 9, surface scratches were not observed by visual observation, or only small surface scratches were observed. In the test specimen 4, cracks occurred in the film with a large thickness after superplastic forming. The test specimen 10, in which the film was not formed, exhibited inferior releasability and produced surface scratches. The test specimen 11, to which BN was applied according to a related-art method without forming a film, exhibited good releasability, but produced surface scratches.

Obviously, numerous modifications and variations of the present invention are possible in light of the above teachings. It is therefore to be understood that, within the scope of the appended claims, the invention may be practiced otherwise than as specifically described herein.

What is claimed is:

1. In an aluminum alloy sheet having a surface brought into contact with a die and subjected to superplastic forming in the die, the improvement comprising said surface of the aluminum alloy sheet having a two-layer film comprising a first film formed by etching the aluminum alloy sheet with an alkaline solution and a boehmite film formed on the first film and being in contact with the die.

2. The aluminum alloy sheet of claim 1, wherein the two-layer film has a thickness up to 10 μm.

3. The aluminum alloy sheet of claim 1, wherein the aluminum alloy sheet is a 5000 or 6000 series aluminum alloy sheet.

* * * * *